United States Patent [19]

Curtis et al.

[11] 4,209,173

[45] Jun. 24, 1980

[54] CROSSWORD PUZZLE GAME EQUIPMENT

[75] Inventors: Alexander Curtis, Beverly Hills; Mark L. Landsberg, Venice; Edwin J. Meyers, Malibu, all of Calif.

[73] Assignee: Omnion, Incorporated, Los Angeles, Calif.

[21] Appl. No.: 926,328

[22] Filed: Jul. 20, 1978

[51] Int. Cl.[2] ..... A63F 9/00

[52] U.S. Cl. ..... 273/240; 273/272; 273/285

[58] Field of Search ..... 273/240, 272, 265, 296, 273/284; 283/1 A; 281/33; 35/35 H, 35 R

[56] References Cited

U.S. PATENT DOCUMENTS

| | | | |
|---|---|---|---|
| 1,568,548 | 1/1926 | Edelson | 35/35 R |
| 1,595,221 | 8/1926 | Brown | 35/35 R |
| 1,633,445 | 6/1927 | Gail et al. | 273/272 |
| 1,745,946 | 2/1930 | Murray | 273/296 |
| 2,050,498 | 8/1936 | Mitchell | 35/35 H |
| 2,138,496 | 11/1938 | Light | 281/33 |
| 2,749,129 | 6/1956 | Vose | 273/157 R |
| 2,782,530 | 2/1957 | Larroca | 35/35 H |
| 2,795,863 | 6/1957 | Warwick | 35/35 H |
| 3,081,088 | 3/1963 | Kast | 273/240 |
| 3,152,806 | 10/1964 | Jackman | 273/272 |
| 3,174,753 | 3/1965 | Miller | 273/157 R |
| 3,472,514 | 10/1969 | Green | 273/272 |

FOREIGN PATENT DOCUMENTS

| | | | |
|---|---|---|---|
| 1442375 | 5/1966 | France | 35/35 R |
| 2023 | of 1871 | United Kingdom | 273/284 |

*Primary Examiner*—Richard C. Pinkham
*Assistant Examiner*—Scott L. Brown
*Attorney, Agent, or Firm*—Warren, Chickering & Grunewald

[57] ABSTRACT

Crossword puzzle game equipment is disclosed which includes a game board having an array of columns and rows of side-by-side spaces that are sequentially numbered but do not define a puzzle pattern. The game equipment further includes a clue book having a plurality of crossword puzzle clues or definitions printed thereon and a puzzle pattern defining list of selected numbers of spaces which are to be blacked out or otherwise designated as non-playing spaces to form the puzzle pattern. The clue book is preferably formed for free-standing support in a generally vertical orientation proximate the game board to act as a privacy shield for competition between multiple players having the same game equipment and simultaneously solving the same crossword puzzle. Optionally, the clue book is mounted to a foldable game board to provide the privacy shield and a clue support structure.

7 Claims, 6 Drawing Figures

Mark out: 5, 9, 30, 34, 55, 59, 82, 101, 13 x 13
ACROSS
1. Strike
6. Under — table
10. — of Zorro
26. Spoken
31. Annexation
35.
51.
DOWN
1. Pueblo Indian
2. Persia
3. Diplomacy
4. Shirt Part
6. Rollinline
7.
SCORING
1000

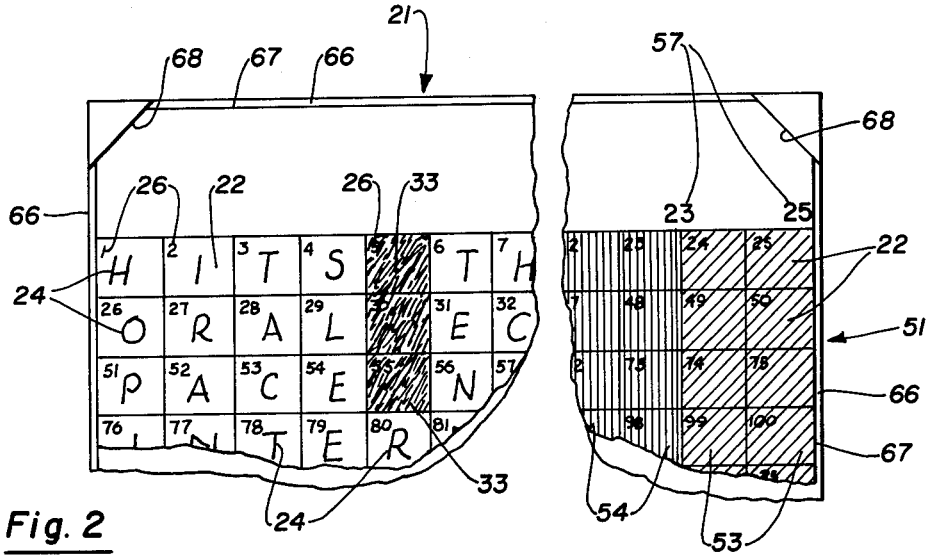
Fig. 2
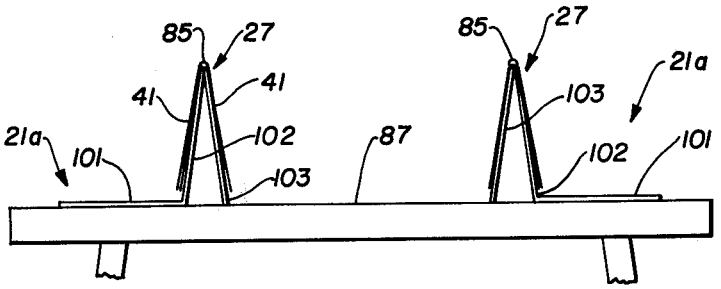
Fig. 3
Fig. 4
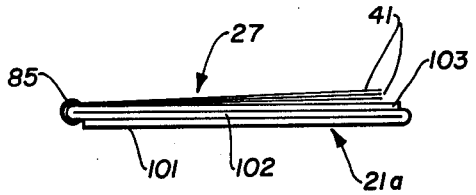
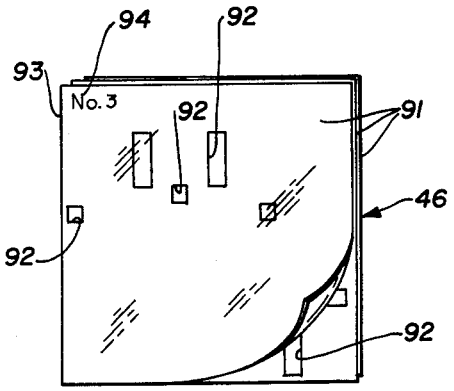
Fig. 6
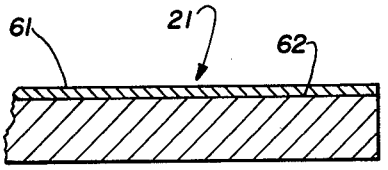
Fig. 5

CROSSWORD PUZZLE GAME EQUIPMENT

BACKGROUND OF THE INVENTION

One of the most enduring and widely appealing mediums for entertaining oneself has been the crossword puzzle. Crossword puzzles come in a wide range of sizes and degrees of difficulty, and accordingly, they can be tailored to almost any level of skill or intelligence.

Understandably, the long popularity of crossword puzzles has spawned numerous attempts to provide game equipment which incorporates at least some of the features which make crossword puzzles interesting and entertaining. Undoubtedly, the most successful of these attempts has been the game equipment commercially sold under the trademark SCRABBLE. Although SCRABBLE game equipment can be used to play a very entertaining and popular game, it is not a true crossword puzzle game in which clues or definitions form the basis for generating an interlocking pattern of words.

Other attempts to incorporate some or all of the features of crossword puzzles into game equipment may be seen in U.S. Pat. Nos. 3,472,514, 3,174,753, 3,152,806, 3,081,088, 2,795,863, 2,749,129, Re 24,409, 2,050,498 and 1,633,445. In U.S. Pat. Nos. 3,174,753 and 2,749,129, attempts have been made to combine crossword puzzles and jigsaw puzzles. In both of these patents, the apparatus disclosed employs a pre-formed crossword puzzle pattern of spaces and blacked out areas, and the solution to the puzzle is also entered into the spaces. The individual words formed by the crossword puzzle are, however, separated into jigsaw-like pieces that can be fitted together based upon clues contained on the board or the tiles themselves. While being an interesting combination of the features of a jigsaw puzzle and a crossword puzzle, the resultant games tend to diminish the crossword puzzle aspect of the game equipment.

In U.S. Pat. No. Re 24,409, game equipment is disclosed in which pre-formed puzzle patterns are provided and the crossword puzzle is "solved" by a trial and error type of process that is eventually assisted by the use of crossword puzzle skills. The puzzle itself, however, is not solved through the use of definitions or clues.

U.S. Pat. Nos. 3,472,514, 3,152,806 and 1,633,445 are crossword puzzle game equipment in which there is an array of spaces or areas that are delineated but unnumbered. These puzzle games do not depend upon the use of clues or definitions, with the exception that categories are provided to control play to some degree in U.S. Pat. No. 3,152,806. While definitely word games, they tend to be more like the SCRABBLE word game than a true crossword puzzle. In U.S. Pat. No. 3,152,806, pre-printed puzzle patterns can also be used as a further constraint on the construction of words in various categories.

U.S. Pat. Nos. 3,081,088, 2,795,863 and 2,050,498 each disclose game equipment in which there is an array of columns and rows of unnumbered spaces that form the basis for play of the games. Of these three patents, U.S. Pat. No. 3,081,088 is not directed to the play of a word or puzzle game, but instead is game apparatus for the play of an obstacle type of game.

In both U.S. Pat. Nos. 2,795,863 and 2,050,498, the game equipment is contemplated for use with a crossword puzzle diagram of the type conventionally found in a newspaper, puzzle book or the like. The game equipment includes lettered tiles and numbered tiles or pegs, together with blacked out tiles, that can be positioned over the board. The numbering and puzzle pattern conform to the puzzle as set forth in the newspaper, magazine, etc., and the newspaper clues are used to solve the puzzle. Thus, the game equipment is basically designed to enable the transfer of an existing crossword puzzle to a puzzle board with attendant advantages such as the elimination of the need for erasing. Unfortunately, however, such game equipment also inherently includes an extremely large number of pieces, many of which have to be kept or stored in a sequential order for use with the game equipment.

OBJECTS AND SUMMARY OF THE INVENTION

A. Objects of the Invention

Accordingly, it is an object of the present invention to provide crossword puzzle game equipment suitable for play of a true crossword puzzle game on a solitaire or competitive basis.

Another object of the present invention is to provide crossword puzzle game equipment having a minimum number of pieces and accordingly attendant simplicity and practicality of use.

Still a further object of the present invention is to provide crossword puzzle game equipment in which the simultaneous play of an interesting and competitive crossword puzzle game by a plurality of players can be accomplished.

It is also an object of the present invention to provide crossword puzzle game equipment which is relatively inexpensive to manufacture, is durable, may be compactly stored when not in use, is convenient and easy for a player to use, and is adaptable to all ages and ranges of player skill.

The crossword puzzle game equipment of the present invention has other features of advantage and objects which will become apparent from or are set forth in more detail in the following description of the preferred embodiment and the accompanying drawing.

B. Brief Summary of the Invention

The crossword puzzle game equipment of the present invention includes game means having an array of spaces, at least some of which are numbered or distinguishably identified with indicia, and clue means on which a set of clues is set forth and correlated to numbers for the spaces. The improved game equipment is comprised, briefly, of the array of spaces, formed as side-by-side columns and rows, without any puzzle pattern defined on or formed by the spaces, but all of the spaces are pre-printed or preferably pre-numbered in a consecutive manner. Additionally, the improved game equipment includes a plurality of different sets of clues and a plurality of puzzle pattern defining means formed to enable designation of a plurality of different sets of spaces as non-playing or blacked out spaces to define different puzzle patterns. The puzzle pattern defining means are further correlated to a selected set of clues.

In the preferred form, the puzzle pattern defining means is comprised of a series of space identifying numbers which are printed on each of the plurality of clue or definition sheets that accompany the game board of the present invention. The clue means is preferably in the form of a clue book that can be placed in a free-standing nearly vertical position in front of the game board for convenience in reading the clues and to act as a privacy shield for competitive play. The game board further may optionally be foldably constructed with the clues or clue book mounted thereto to provide a privacy shield and clue sheet support structure. The game board is also further preferably formed so that the puzzle entries, including the puzzle pattern, can be readily removed or erased from the game board surface for the solution of different puzzles on the same game board.

DESCRIPTION OF THE DRAWING

FIG. 2 is an enlarged, fragmentary, top plan view of a modified form of the game board of the present invention.

FIG. 3 is a fragmentary, side elevational view of two sets of a further modified form of game board equipment constructed in accordance with the present invention, as supported on a table or the like.

FIG. 4 is a side elevational view of the game board of FIG. 3, shown in a stored position.

FIG 5 is an enlarged, fragmentary, cross-sectional view of a section of the game board of FIG. 1.

FIG. 6 is a top plan view of a die cut sheet usable with the game equipment of FIG. 1.

DESCRIPTION OF THE PREFERRED EMBODIMENT

Figure 1:
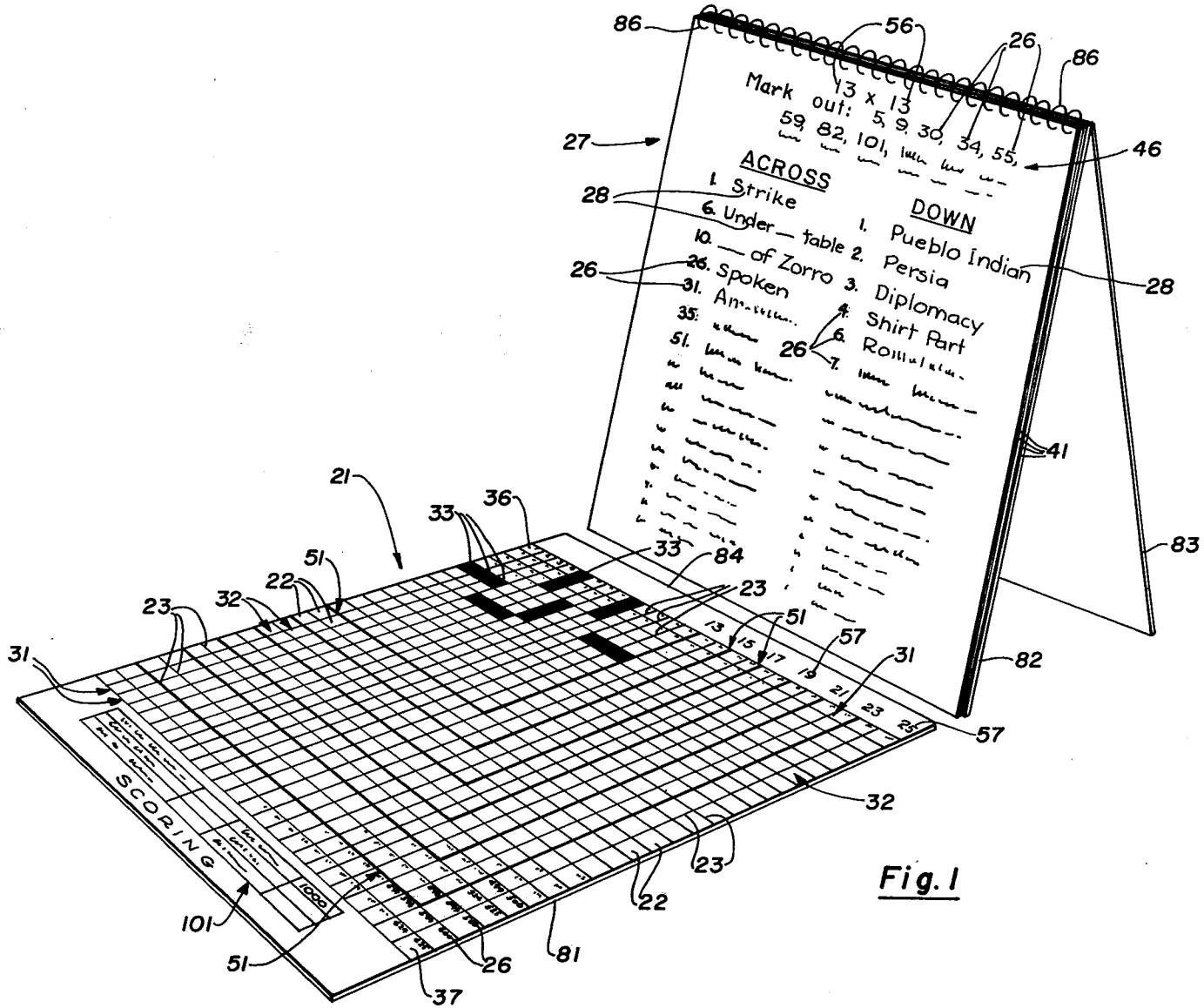
FIG. 1 is a top perspective view of crossword puzzle game equipment constructed in accordance with the present invention.

Referring now to FIG. 1, the crossword puzzle game equipment of the present invention can be seen to include game board means, generally designated 21, having an array of spaces, squares or areas 22 defined or delineated by lines 23 on an upper surface of the game board. Spaces 22 have an area sufficient for the entry of characters, preferably letters 24 (FIG. 2), therein. As is the case for a conventional crossword puzzle, the game board of the present invention includes a plurality of distinguishable space identifying indicia 26 positioned proximate at least some of spaces 22. As is also the case with a conventional crossword puzzle, the game equipment of the present invention includes clue means, generally designated 27, associated with the game board. Clue means 27 has a set of clues or definitions 28 and selected of the space identifying indicia 26 correlated to individual clues or definitions to enable the solution of a crossword puzzle by means of the game equipment.

As thus far described, the game equipment includes elements which are found in a conventional crossword puzzle of the type contained in puzzle books and periodicals. In the improved game equipment of the present invention, however, a multiplicity of different puzzles can be solved on a single game board, and these puzzles can be solved in competition with other players.

Thus, in the improved game board of the present invention, the array of spaces 22 is formed as side-by-side columns 31 and rows 32 of spaces, which are devoid or completely without any puzzle pattern defined thereby or thereon. As shown in the upper left hand corner of the array of FIG. 1, a portion of a puzzle pattern is illustrated and defined by blacked out spaces 33 on the game board. As used herein, the expression "puzzle pattern" shall mean a pattern of the type in which certain spaces, areas or squares are blacked out or otherwise designated as non-playing spaces in order to limit the formation of words in the puzzle. Conventionally, these puzzle patterns are symmetrical, although asymmetric patterns are also well within the scope of the present invention.

When the game board 21 reaches the player from the manufacturer, it does not have any of spaces 33 blacked out or otherwise designated as non-playing spaces. Instead, the array of spaces on the game board is devoid of any puzzle pattern and simply is comprised of columns and rows of side-by-side spaces.

While the game board has no puzzle pattern thereon, the apparatus of the present invention does include space identifying indicia 26 which are pre-printed, formed or otherwise permanently disposed proximate each and all of the spaces in the array on the game board so as to identify and distinguish each space. This is preferably accomplished by numbering the spaces consecutively from the top left hand corner space 36 to the bottom right hand corner space 37. In the game board illustrated in FIG. 1, there are 25 columns and 25 rows of spaces, with each space being identified by consecutive integers from 1 to 625. Numbers or indicia 26 are not shown in each of the spaces in FIG. 1 for the sake of illustration, but can be seen in all of the spaces illustrated in FIG. 2.

As best may be seen in FIG. 2, the spaces 33, which are blacked out or otherwise designated as non-playing spaces by the player at the start of the game, contain a space identifying indicia or number 26. Such a pre-numbering of all of the spaces, including the non-playing spaces, is not found in conventional crossword puzzles or in prior game equipment based upon crossword puzzles. In prior game equipment the non-playing spaces either bear no number or numbering is added by numbering tiles, pegs, etc., which greatly complicate the number and manipulation of pieces comprising the game equipment.

In order to enable the solution of the multiplicity of puzzles, the game board apparatus or equipment of the present invention preferably includes a plurality of different sets of clues. Thus, clue means 27 may advantageously be formed as a clue book having a plurality of sheets 41, each of which contains a set of clues or definitions. Thus, each of sheets 41 contains the clues necessary to solve a different crossword puzzle.

While it would be possible to solve a plurality of puzzles having the same basic puzzle pattern by means of changing or varying the clues, such an approach lacks creativity and would inhibit the number of puzzles which could be formed. Accordingly, it is a further important feature of the present invention that the crossword puzzle game equipment include a plurality of puzzle pattern defining means, generally designated 46, formed to enable designation of a plurality of different sets of spaces 22 in the array as non-playing spaces in order to define a plurality of different crossword puzzle patterns. Moreover, puzzle pattern defining means 46 is formed for correlation of each puzzle pattern to a selected set of clues 28.

The formation of puzzle pattern defining means 46 can be accomplished in several manners, but it is preferable that the puzzle pattern defining means take the form of a list or set of space identifying indicia 26 set forth on the same sheet 41 as the clues for the puzzle so as to correlate the spaces to be blacked out or designated as non-playing spaces with the set of clues. Each of sheets 41, therefore, will have a list of symbols 26 together with a designation, e.g., "mark out," as indicated at 47. Thus, the player can, as a first step to playing with the game equipment, black out, cross out, line through, color code or otherwise designate the spaces on board 21, which are set forth in the list comprising puzzle pattern defining means 46, as non-playing spaces or areas in which letters are not to be entered.

In order to provide a game board which will accommodate a wide variety of puzzle patterns and yet be relatively easy and simple for the player to use, it is further preferable that game board 21 include puzzle perimeter defining means, generally designated 51. Moreover, there are preferably a plurality of puzzle perimeter defining means 51 which may advantageously take the form of lines that are thicker or darkened, as shown in FIG. 1, so as to make it readily visually apparent as to where the perimeter of the puzzle extends. It is also preferable that such puzzle perimeter defining means or lines 51 are used in combination with one of the corners of the game board so as to reduce the number and visual complexity of the lines required by always employing a common corner, in this case the upper left hand corner. As will be apparent, however, the perimeter could be defined by lines 51 extending around the center of the game board or some other location.

As best may be seen in FIG. 2, the perimeter defining means 51 can also take the form of color coded spaces 22, as is indicated by the color coding of columns 53 for the color brown and columns 54 for the color red.

As an aid to the player in forming the puzzle pattern on the blank array of spaces, it is further preferable that the clue sheets 41 include indicia 56 indicating the size of the perimeter, with corresponding indicia 57 on the game board proximate the perimeter. It is immediately apparent to the player from looking at clue sheet 41, as illustrated in FIG. 41, that the puzzle to be solved is a 13 by 13 square perimeter, which is the first darkened line 51 on the array of spaces. All of the spaces or squares to be blacked out will fall within the 13 by 13 perimeter. It might be noted, that it would be possible to list, as spaces to be blacked out, all of the spaces surrounding the perimeter of the puzzle, but the use of lines or color coded spaces and indicia to enable a rapid visual perception of the boundries of the puzzle is a much less tedious way of defining the puzzle perimeter.

Game board means 21 can take several forms in the apparatus of the present invention. It is preferable, however, that it be formed as a paper or plastic sheet having an upwardly facingly playing or recording surface 61 (FIG. 5) on which characters, such as letters 24, and puzzle pattern defining entries, such as blacked out areas 33, can be made. Surface 61 is further also preferably formed for easy removal or erasure of the entries on the recording surface. Thus, a high gloss surface which will accept ink from a fiber tipped pen or the like or a crayon-type of marking instrument is particularly well suited for use in the present invention. The identifying numbers or indicia 26 are permanently printed on the board, but the entry of letters 24 and blacked out spaces 33 is done by the player with a pen or marking instrument. Advantageously, the space identifying indicia 26 can be printed on a first layer 62 of the game board with recording surface 61 provided by superimposing a transparent second layer over surface 62. If a composite paper based board is employed, the lines 23 and numbers 26 can be imprinted on the paper before laminating a transparent plastic layer over the board or impregnating the same with a transparent plastic that will provide the smooth upper surface for receipt and easy erasure of puzzle entries. The board can also be made out of a plastic material which will have the array of squares or areas in which the necessary entries can be made to define the puzzle pattern.

As may be seen in FIG. 2, game board means 21 can also be formed with a supporting base structure 66 on which a sheet 67, including a pre-printed array of puzzle squares or spaces, is removably mounted. Thus, the sheet 67 can be held to base 66 by means of corner securement means 68, under which the corners of the sheet 67 may be inserted so as to hold the sheet on the base. Again, the array of spaces would be consecutively numbered and would not have a pre-printed puzzle pattern thereon.

In its broadest aspect, the game board means can even be provided by an array of columns and rows of spaces having identifying numbers as displayed on a cathode-ray tube. Thus, the game equipment of the present invention can be readily adapted for use as a video game by adding a memory capacity to a video display of the array of spaces so that selected clues and the puzzle pattern defining spaces can be selectively called up and entries made in the spaces by use of a cursor and keyboard.

As may be seen in FIG. 1, clue book 27 is preferably formed as a foldable book having a spiral top edge. Cover sections 82 and 83 are hinged together by a spiral binding structure 86. The clue book of the present invention is shown in a deployed position in FIG. 1 with cover sections 82 and 83 folded to a position in which they are self supporting in a nearly vertical position. Thus, sections 82 and 83 form a free-standing triangular or A-frame structure, which is employed in the apparatus of the present invention to accomplish two functions. First, the vertically oriented clue book provides a privacy screen so that when two players are competitively playing with the game apparatus, clue book 27 effectively prevents the opposing player fromm seeing the puzzle as it is being solved by his opponent.

The second function of the clue book is to provide a convenient support structure for clue sheet 41. The various clue sheets 41 can be flipped over so that the desired puzzles to be solved faces game board section 81. The remainder of sheets 41 will either be under the top sheet or hanging down along cover section 83 on the other side of spiral binding 86.

As thus constructed, competing players can position identically formed game boards, with identically formed clue books 27, opposite each other on a table so that the clues for the puzzle to be solved are conveniently displayed toward them, while the upstanding clue books provide the privacy necessary for competitive puzzle solving.

An alternate embodiment of the game equipment of the present invention is shown in FIGS. 3 and 4 in which the clue book has been mounted to foldable sections of the game board. Thus, game board **21*a* is formed with a horizontal section 101 on which the array of spaces is imprinted. Extending upwardly to provide an A-frame privacy screen are board sections 102 and 103, which are hinged together with each other and section 101 to provide a foldable unit. Clue sheets 41 are mounted to board sections 102 and 103 by rings 85, or the like, and the board will be self supporting or free-standing on a table 87 or similar support surface. FIG. 4 illustrates the manner in which game board 21*a* can be folded for compact storage with clue sheets 41** mounted thereto.

In order to provide an alternative puzzle pattern defining means 46, a plurality of sheets 91 (FIG. 6) may be provided having die cut openings 92 therein that are in indexed relation to an edge or corner 93, or some indicia (not shown) on the sheet. Sheets 91 can be lined up with the blank or empty array of spaces on the game board, and a marker can be used to mark the spaces 33 that will be designated as non-playing spaces through openings 92.

As will be appreciated, the use of sheets 91 as puzzle pattern defining means 46 requires a different die cut sheet for each different puzzle pattern to be formed, and it would be accordingly desirable to identify each of sheets 91 by indicia 94 so as to correlate the same to a similar indicia (not shown) on the clue sheets 41.

The crossword puzzle game equipment of the present invention can be used by a single player for his own amusement or by virtually any number of players for simultaneous competitive play. In order to enable scoring of competive play, it is preferable that each puzzle be given a numerical score which would stand for a perfect solution of the puzzle. The number of mistakes made in solving the puzzle as well as the number of spaces or squares left empty could be deducted from the perfect score. In the preferred formula of the scoring, a perfect score of 1,000 is preferably used. From this, two points are deducted for each letter which is entered and is incorrect and one point is deducted for each space which is left blank. This scoring will normally produce a "positive" net score for even the very large, 25 by 25 puzzles, if even a modest number of the entries are correctly made.

In order to facilitate scoring, a score sheet format, generally designated 101, can be provided on board section 21 proximate the puzzle array. Moreover, the sides of sheets 41 opposite to the sides on which the clues or definitions are printed can carry a printed solution to the puzzle (not shown). Still further, this solution may be advantageously inverted on the back sides of sheets 41 so that the sheets can be lifted and pivoted up to a vertical position above the clue book so that the players can check their solved answers against the printed answer.

It is preferable to provide clue means or book 27 as a series of puzzles in which the difficulty and complexity as well as the size and configuration of the puzzle patterns change. For example, a package of 30 puzzles may be divided into a group of 10 puzzles 13 by 13 squares on a side plus another group of 10 puzzles 15 by 15 and groups of two puzzles each which are, respectively, 17 by 17, 19 by 19, 21 by 21, 23 by 23 and 25 by 25.

What is claimed is:

1. Crossword puzzle game equipment including, game board means having an array of side-by-side columns and rows of spaces defined thereon each formed for the entry of characters therein, said game board means further including a plurality of distinguishable space identifying indicia positioned proximate all of said spaces; and clue means associated with said game board means and including a plurality of sets of clues with selected of said space identifying indicia correlated to each clue of said sets of clues to enable solution of a plurality of crossword puzzles, wherein the improvement in said game equipment is comprised of:

a plurality of sets of said space identifying indicia selected to provide a plurality of puzzle pattern defining means by designating a plurality of different sets of spaces in said array as non-playing spaces to define a plurality of different crossword puzzle patterns, said plurality of sets of space identifying indicia further being correlated to a selected set of said sets of clues; and said game board means being formed with a planar continuous unobstructed upwardly facing recording surface, and said columns and rows of spaces being defined on and said non-playing spaces and entry of said characters used to solve said crossword puzzles are both recorded on said continuous unobstructed upwardly facing recording surface.

2. The crossword puzzle game equipment as defined in claim 1 wherein, said recording surface is formed for temporary recording of character and puzzle pattern defining entries thereon, and said recording surface is further formed to enable removal of the entries recorded on said recording surface.

3. The crossword puzzle game equipment as defined in claim 1 wherein, said clue means is provided as a clue book having a plurality of sheets each of which includes one of said set of clues imprinted on a first side thereof and an answer imprinted on a second side thereof, said book being formed for free-standing self support in a generally vertical orientation on a horizontal support surface proximate said game board means to provide a privacy shield with said sets of clues being displayed for reading in a direction facing said game board means.

4. The crossword puzzle game equipment as defined in claim 1 wherein, said game board means is provided as a game board having three sections connected together by hinge means to enable folding of said game board to a compact configuration for storage, said array of spaces being provided on a first of said sections, said first of said sections being generally horizontally oriented when in a deployed position, and the remaining two of said sections being foldable to a deployed position at which said remaining two of said sections are self supporting in a nearly vertical position to provide a privacy shield.

5. The crossword puzzle game equipment as defined in claim 4 wherein, said clue means is provided by a plurality of sheets bound together as a unit with each sheet having one set of said clues imprinted thereon, and said clue means is mounted to said game board for support from said remaining two of said sections in a near vertical orientation with said set of clues facing said first of said sections when said remaining two of said sections are in said deployed position.

6. Crossword puzzle game equipment including, game board means having an array of spaces defined thereon each formed for the entry of characters therein, said array of spaces being formed as side-by-side columns and rows of spaces without any puzzle pattern defined thereon, and said game board means having distinguishable space identifying indicia pre-printed proximate each and all of said spaces in said array; clue means associated with said game board means and including a plurality of different sets of clues with selected of said space identifying indicia correlated to each clue in each set of clues to enable solution of a plurality of crossword puzzles; a plurality of puzzle pattern defining means formed to enable designation of a plurality of different sets of spaces in said array as non-playing spaces to define a plurality of different crossword puzzle patterns, said plurality of puzzle pattern defining means further being formed for correlation of each puzzle pattern to a selected set of said sets of clues; and puzzle perimeter defining means formed to define a perimeter of the puzzle to be solved on said array of spaces, said perimeter defining means defining a plurality of differing puzzle perimeters; wherein the improvement in said game equipment is comprised of:

said puzzle perimeter defining means includes perimeter defining indicia on each of said clue means correlated to selected of perimeter defining indicia provided on said game board means.

7. The crossword puzzle game equipment as defined in claim 6 wherein, said perimeter defining means on said game board is provided by color coding of selected of said spaces.

* * * * *